US006412892B1

(12) United States Patent
Bonat

(10) Patent No.: US 6,412,892 B1
(45) Date of Patent: Jul. 2, 2002

(54) LATERAL GUIDE FOR A CUPBOARD SLIDE-OUT SYSTEM

(75) Inventor: Günter Bonat, Lochau (AT)

(73) Assignee: Fulterer Gesellschaft m.b.H., Lustenau (AT)

( * ) Notice: Subject to any disclaimer, the term of this patent is extended or adjusted under 35 U.S.C. 154(b) by 0 days.

(21) Appl. No.: 09/433,417

(22) Filed: Nov. 4, 1999

(30) Foreign Application Priority Data

Nov. 4, 1998 (AT) ..... 715/98 U

(51) Int. Cl.[7] ..... A47B 88/00

(52) U.S. Cl. ..... 312/334.47; 312/334.45; 312/334.25

(58) Field of Search ..... 312/334.44, 344.45, 312/334.46, 334.47, 334.6, 334.9, 334.15, 334.25, 334.28, 334.31, 334.26

(56) References Cited

U.S. PATENT DOCUMENTS

| | | | | | |
|---|---|---|---|---|---|
| 2,004,057 | A | * | 6/1935 | Schmitz | 312/334.44 X |
| 3,462,203 | A | * | 8/1969 | Vecchio | 312/334.47 X |
| 4,423,914 | A | * | 1/1984 | Vander Ley | 312/334.47 X |
| 5,281,021 | A | * | 1/1994 | Rock et al. | 312/334.46 X |
| 5,417,490 | A | * | 5/1995 | Hobbs et al. | 312/334.47 |
| 5,634,703 | A | * | 6/1997 | Vonier | 312/334.44 X |
| 5,730,514 | A | * | 3/1998 | Hashemi | 312/334.47 X |
| 5,775,787 | A | * | 7/1998 | Gasser | 312/334.46 X |
| 5,823,649 | A | * | 10/1998 | Hinrichs | 312/334.45 |
| 5,988,780 | A | * | 11/1999 | Rock et al. | 312/334.46 |
| 6,015,199 | A | * | 1/2000 | Netzer et al. | 312/334.46 X |

FOREIGN PATENT DOCUMENTS

| | | |
|---|---|---|
| AT | 326303 | 12/1975 |
| AT | 372829 | 11/1983 |
| AT | 404313 | 10/1998 |

* cited by examiner

*Primary Examiner*—Peter M. Cuomo
*Assistant Examiner*—Hanh V. Tran
(74) *Attorney, Agent, or Firm*—Sidley Austin Brown & Wood, LLP

(57) ABSTRACT

A lateral guide for a slide-out system for a cupboard and including at least one first rail securable to an inner side of a top of a furniture member or an upper surface of a pull-out furniture section and having a plurality of guide rollers supported on vertical axles, a second, substantially U-shaped rail securable to another of an inner side of a top of the furniture member and an upper surface of the pull-out furniture section and having cheeks along which the guide rollers roll upon actuation of the slide-out system, and a stop member for limiting displacement of the first and second rail relative to each other in a pull-out direction and including at least one stop supported at a front or rear end of a cheek of the second rail and projecting into a recess in the cheek, and a spar for supporting the at least one stop for pivotal movement with respect to a plane of the cheek and formed of an elastically deformable material, extending in a longitudinal direction of the second rail, and having its end supported on the cheek.

15 Claims, 3 Drawing Sheets

A
B
H
L
14
15
16
17
18
19
20
21
22
23
24
25
26
27
28

LATERAL GUIDE FOR A CUPBOARD SLIDE-OUT SYSTEM

BACKGROUND OF THE INVENTION

1. Field of the Invention

The present invention relates to a lateral guide for a slide-out system for a cupboard including a furniture member and a pull-out furniture section, with the lateral guide including at least one first rail securable to one of an inner side of a top of the furniture member and an upper surface of the pull-out furniture section and having a plurality of guide rollers supported on vertical axles, a second, substantially U-shaped rail securable to another of an inner side of a top of the furniture member and an upper surface of the pull-out furniture section and having cheeks along which the guide rollers roll upon actuation of the slide-out system, and stop means for limiting displacement of the first and second rails relative to each other in a pull-out direction.

2. Description of the Prior Art

Lateral guide of the type described above are well known. They serve for retaining cupboards in an upright position. The conventional lateral guides can include two or more rails. When the lateral guide includes more than two rails, it can be formed as a telescopic or differential device. When a cupboard slide-out device, which is secured on the bottom of a cupboard with a pull-out section, includes a stop for limiting relative displacement of rails which form the slide-out system, it is preferable and advantageous and also necessary to limit relative displacement of the rails forming the lateral guide which is secured to the top of the cupboard.

Austrian Patent No. 404,313 discloses a slide-out system for a pull-out drawer. The known slide-out system includes a carcass rail securable to a stationary part of a piece of furniture, a pull-out load-carrying rail, and an intermediate rail with three flanges which serves as running tracks for running rollers. The rollers are provided on the rails. One roller is provided at a front end of the intermediate rail at which a lower vertical web is provided. Above this roller, there is provided a recess. A stop, which limits the pull-out path, is provided between the load-carrying rail and the intermediate rail. A stop for a roller, which is provided at the rear end of the load-carrying rail, is arranged on the lower flange of the intermediate rail and can be lowered relative to this flange. The stop projects through a recess which is formed in the lower flange. The stop is supported on a spar which extends in a longitudinal direction of the rail and is formed of an elastically deformable material. The spar adjoins the bottom side of the flange and has one of its end supported on the flange. The stop has a shape of a hook that engages an edge of the recess through which the stop projects. The spar is displaceable in a longitudinal direction of the rail.

The lateral guides of the type described above have guide rollers the support axles of which extend vertically. They roll along side cheeks of the U-shaped rail upon actuation of the slide-out device.

Accordingly, an object of the present invention is to provide a stop for reliably limiting the pull-out path upon displacement of a U-shaped rail relative to a carcass rail without substantial additional expenses associated with provision of the stop and without adversely influencing the functioning of the slide guide.

SUMMARY OF THE INVENTION

This and other objects of the present invention, which will become apparent hereinafter, are achieved by providing stop means which includes at least one stop supported at one of front end and rear end of one of the cheeks of the second rail and projecting into a recess in the one of the cheeks of the second rail, and a spar for supporting the at least one stop for pivotal movement with respect to a plane of the one of the cheeks, with the spar being formed of an elastically deformable material, extending in a longitudinal direction of the second rail, and having one end thereof supported on the one of the cheeks.

According to the present invention, a relatively large stop is provided within the circumferential profile or inside the rail contour, which stop reliably prevents overtravel of the guide rollers.

The novel features of the present invention, which are considered as characteristic for the invention, are set forth in particular in the appended claims. The invention itself, however, both as to its construction and its mode of operation, together with additional advantages and objects thereof, will be best understood from the following detailed description of preferred embodiments, when read with reference to the accompanying drawings.

Figure 1:
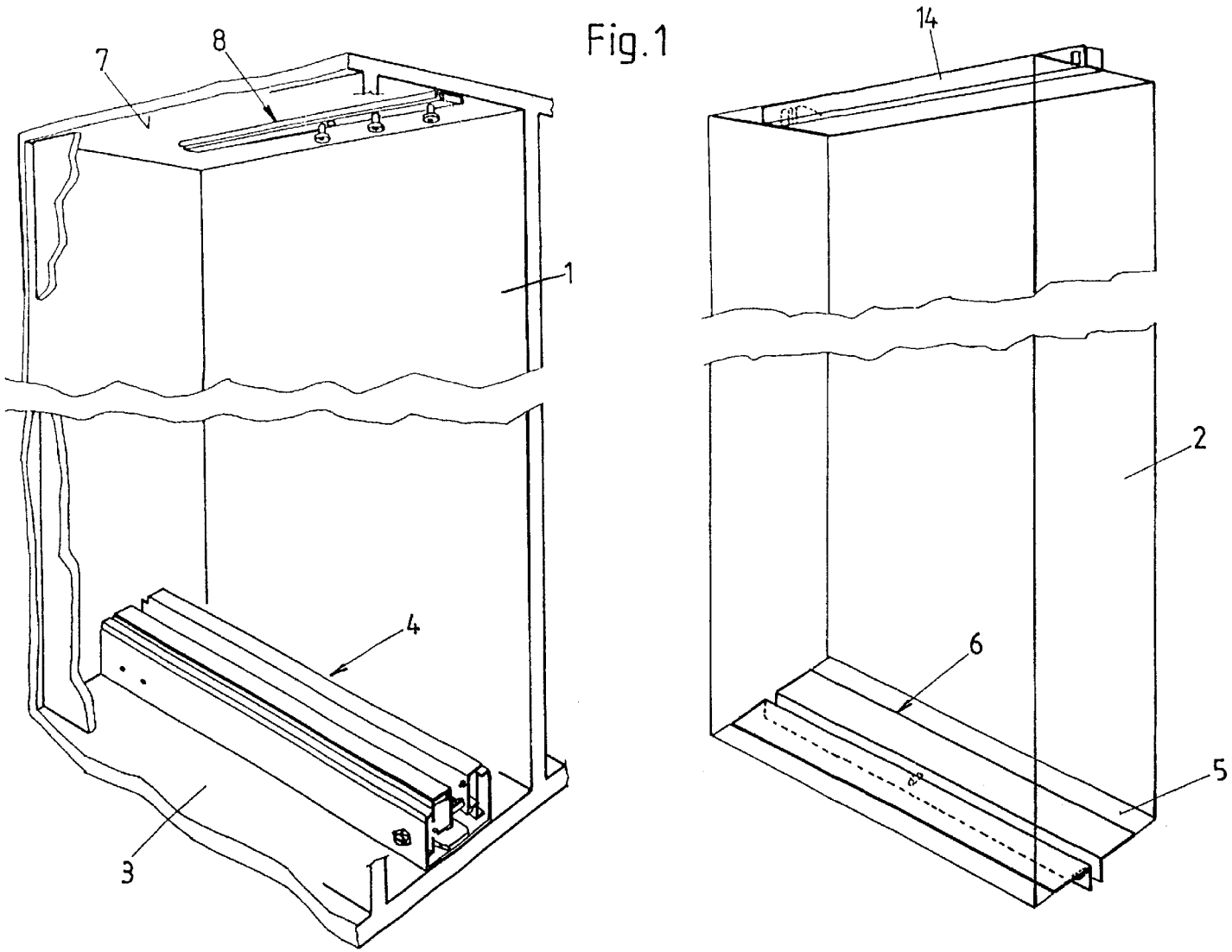
FIG. 1 side exploded view of a tall cupboard with a slide-out system and a lateral guide.

DESCRIPTION OF THE PREFERRED EMBODIMENTS upboard, which is shown in FIG. 1, consists of a stationary furniture member 1 and a slide-out or pull-out furniture section 2, which for the sake of clarity, are separated from each other. A cupboard slide-out device or system 4 is screwed to a bottom 3 of the furniture member 1. The design of the slide-out system 4 is unimportant for the purposes of the present invention and, therefore, it is not shown in detail. There exists a multiplicity of forms of slide-out systems for tall cupboards. A transition rail 6 is secured to the bottom 5 of the pull-out or slide-out furniture section 2. The transition rail 6 connects the pull-out furniture 2 with cupboard slide-out system 4 in a dome-shaped manner.

Figure 3:
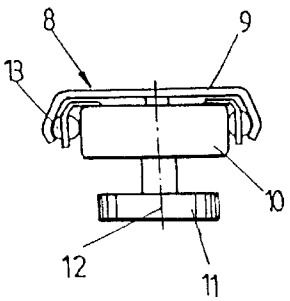
FIG. 3 a side view of the rail shown in FIG. 2.
Figure 2:
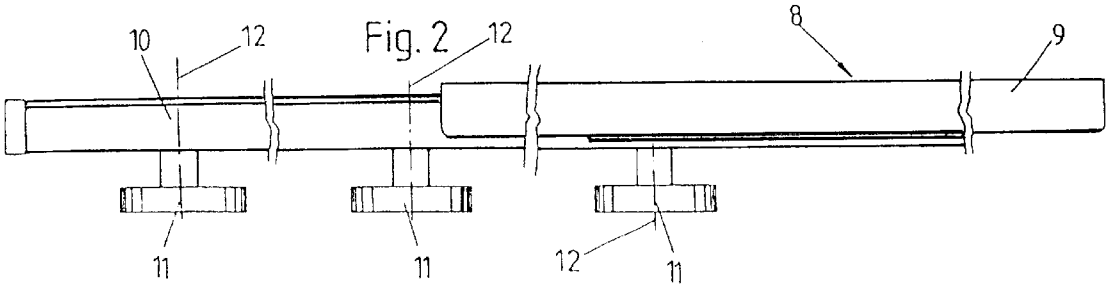
FIG. 2 a front elevational view of a rail fixedly securable to a furniture member and carrying guide rollers.
Figure 4:
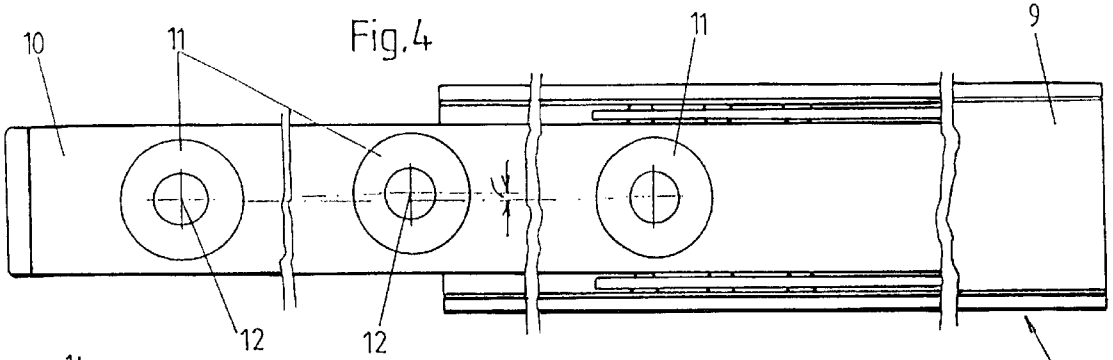
FIG. 4 a bottom view of the rail shown in FIGS. 2–3.
Figure 5:
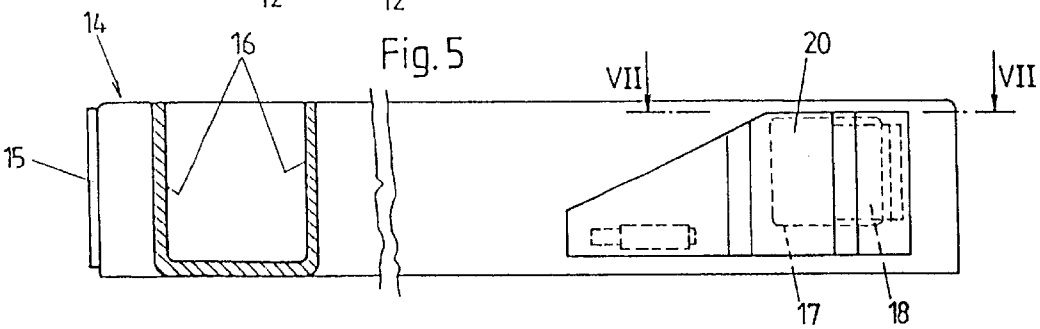
FIG. 5 a front elevational view of a second rail having a U-shaped cross-section.

A first, two-part rail 8 of a lateral guide is secured to the inner surface of the top of the stationary furniture member 1. This first, two-part rail 8 is shown in FIGS. 2–4. The first, two-part rail 8 includes a shaped rail 9 which is securable to the top of the furniture member 1. The shaped rail 9 has flanged end portions. The first rail 8 further includes a second shaped rail 10 that carries a plurality of guide rollers 11 the rotational axles 12 of which extend vertically. In the embodiment shown in the drawings, the shaped rail 10 carries three guide rollers 11. Balls 13 are provided between the first and second shaped rails 9 and 10. Preferably, the balls 13 are located in a cage. The balls 13 provide for the displacement of the shaped rails 9 and 10 relative to each other. In the ends of the two shaped rails 9 and 10, there are provided impressed dents, not shown in detail, which serve as stops and which limit the displacement of the shaped rails 9 and 10 relative to each other.

Figures 6, 7, 8, 9, 10:
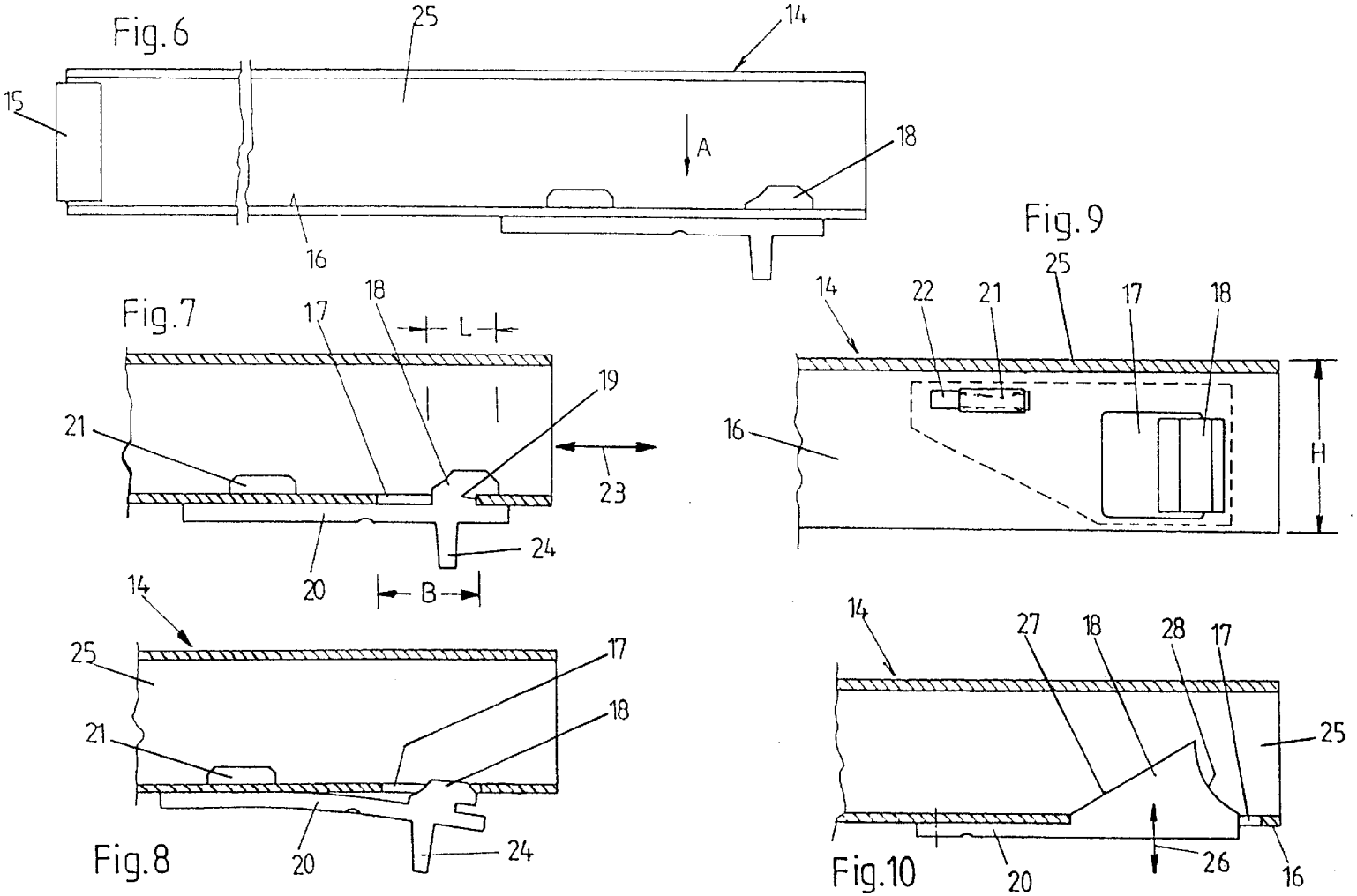
FIG. 6 a plan view of the second rail.
FIG. 7 a cross-sectional view along line VII—VII in FIG. 5.
FIG. 8 a cross-sectional view similar to that of FIG. 7 but with a sidewise displaced stop.
FIG. 9 a detailed view of the stop viewed in the direction shown with arrow A from within the second rail.
FIG. 10 a partial cross-sectional view of a second embodiment of the second rail.

A second, U-shaped rail 14 is secured to the top of the pull-out furniture section 2. One of the ends of the second rail 14 is closed by an insert 15. The other end remains open. In the vicinity of the open end, a window-like recess 17 is formed in a cheek 16 of the second rail 14. A hook-shaped stop 18 projects through the window-like recess 17 and form a lockingly engages a vertical edge 19 of the recess 17 (FIG. 7). The hook-shaped stop 18 forms part of a spar 20 that carries at its end, remote from the stop 18, a strip-shaped projection 21 which extends in a slot 22 formed in the cheek 16. The slot 22 extends in a longitudinal direction of the second rail 14. The width B of the window-shaped recess 17 is somewhat larger than the length L of the stop 8 measured in a pull-out direction shown with arrow 23. The ends of the stop 18 are bevelled. The slot 22 has such a length that the stop 18 can be displaced in the longitudinal direction of the rail 14 until it becomes congruent with the window-shaped recess 17, as shown in FIG. 8. The stop 18 extends substantially over the larger part of the inner height H of the U-shaped second rail 14. Relative to the stop 18, the projection 21 lies on a side of the rail 14 remote from the adjacent end. The stop 18, the spar 20, and the projection 21 are formed as a one-piece part of a suitable elastically deformable plastic material. The projection 21 is so formed that it can be pressed into the slot 22 and be retained there. A taper can be provided in the middle of the slot 22 which serves as a lock for the projection 21, so that it is necessary to overcome the holding force of the lock upon displacement of the projection 21. The slot 21 is formed adjacent to the lower edge of the second rail 14, i.e., adjacent to the web 25 which connects opposite cheeks 16 of the second rail 14.

Upon mounting of the spar 20, the stop 18 is pushed with a handle strip 24, which is formed integrally with the spar 20, so that the stop 18 is aligned with the window-shaped recess 17. Upon displacement of the second rail 14 against the first rail 8, the guide rollers 11 pushed the stop 18 sidewise outwardly, passing over the window-shaped recess 17. As soon as the guide rollers 11 pass over the stop 18, it pivots in its initial position, with the spar 20 again occupying its locking position (FIG. 7). The cooperating first and second rails 8 and 14 are mounted on the furniture member 1 and the furniture section 2 before the assembly of the furniture. In the embodiment shown in the drawings, the guide rollers 11 are mounted on the first rail 8 which is secured to the stationary furniture member 1, with the U-shaped rail 14 being secured on the pull-out furniture section 2. However, it is within the scope of the present invention to reverse this arrangement and to mount the first rail 8 with the guide rollers 11 on the pull-out furniture section 2, and to mount the second, U-shaped rail 14 on the stationary member 1. The first, two-part rail 8 is so formed that it insures a full pull-out of the pull-out furniture section 2. Preferably, the pullout length of the lateral guide corresponds to that of the slide-out system mounted on the bottom 3 of the furniture member 1.

A simplified embodiment of the present invention is shown in FIG. 10, which corresponds to that of FIGS. 7–8 and in which the similar elements are designated with the same reference numerals. In the embodiment shown in FIG. 10, as in the first embodiment, the stop 18 projects through a window-shaped recess 17 formed in the side cheek 16 of the U-shaped rail 14 and over the spar 20 in the directions shown with double arrow 26. The end of the spar 20 is secured to the cheek 16, as shown with a dash-dot line. The run-on side of the stop 18 has a wedge-shaped slope 27, with the opposite side 28 of the stop 18 being formed as arcuate surface corresponding to the circumference of the guide rollers 11. The stop 18 projects inward from the surface of the U-shaped rail 14 by a distance corresponding at least to the radius of the guide roller 11. However, preferably, the stop 18 projects from the surface of the U-shaped rail 14 inward by a distance exceeding the radius of the guide roller 11. Upon assembly of the furniture member 1 with the furniture section 2, the rollers 11 run on the slope 27 of the stop 18, pushing the stop 18 outwardly, passing the stop 18. As soon as the guide roller 11 pass the stop 18, the stop 18 pivots into its initial position shown in FIG. 10, forming, during functioning of the furniture, an obstacle which the guide rollers 11 cannot overcome. Upon the separation of the furniture section 2 from the stationary furniture member 1, the stop 18 need be displaced sidewise outwardly with an auxiliary tool. In the first embodiment, it is sufficient, upon pulling the stop 18 downwardly, to align it with the window-shaped recess 17, so that the guide rollers 11 can pass thereby.

To provide for a most possible smallest clearance between the first and second rails 8 and 14, respectively, the middle guide roller 11 is somewhat displaced relative to a straight line connecting two outer guide rollers 11 by a distance a, as shown in FIG. 4. At that, preferably, care should be exercised that the guide roller 11 are so arranged that they are located, during the pull-out or pull-in, adjacent to the cheek of the second rail 14 which does not carry the stop 18. This prevents the guide rollers 11 from entering, upon running on the stop 18, in the free region of the window-shaped recess 17 (please see FIG. 9).

Though the present invention was shown and described with references to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A lateral guide for a slide-out system for a cupboard including a furniture member and a pull-out furniture section, the lateral guide comprising at least one first rail securable to one of an inner side of a top of the furniture member and an upper surface of the pull-out furniture section and including a plurality of guide rollers supported on vertical axles; a second, substantially U-shaped rail securable to another of an inner side of a top of the furniture member and an upper surface of the pull-out furniture section and having cheeks along which the guide rollers roll upon actuation of the slide-out system; and stop means for limiting displacement of the first and second rail relative to each other in a pull-out direction and including at least one stop supported at one of front end and rear end of one of the cheeks of the second rail and projecting into a recess in the one of the cheeks of the second rail, and a spar for supporting the at least one stop for pivotal movement with respect to a plane of the one of the cheeks, the spar being formed of an elastically deformable material, extending in a longitudinal direction of the second rail, and having one end thereof supported on the one of the cheeks.

2. A lateral guide as set forth in claim 1, wherein the at least one stop is shaped as a hook adapted to engage an edge of the recess through which the at least one stop projects, and wherein the spar is displaceable in the longitudinal direction of the second rail.

3. A lateral guide as set forth in claim 2, wherein the spar is provided, at an end thereof remote from the at least one stop, with one of a strip-shaped projection and a mushroom-shaped projection which projects into a slot formed in the one of the cheeks and having a length corresponding at least to a displacement path of the at least one stop.

4. A lateral guide as set forth in claim 3, wherein the slot is located adjacent to a foot web of the second, U-shaped rail which connects the two cheeks.

5. A lateral guide as set forth in claim 3, wherein the slot has, in a middle thereof, a reduced width for forming a lock.

6. A lateral guide as set forth in claim 2, wherein the at least one stop has on opposite, viewed in the pull-out direction, sides thereof run-on inclined surfaces.

7. A lateral guide as set forth in claim 3, wherein the at least one stop, the spar, and the projection are formed as a one-piece member of an elastically deformable material.

8. A lateral guide as set forth in claim 3, wherein the projection is spaced in a transverse direction with respect to the at least one stop.

9. A lateral guide as set forth in claim 1, wherein the first rail includes at least three guide rollers, and wherein a middle roller is offset with respect to a straight line connecting another two guide rollers.

10. A lateral guide as set forth in claim 1, wherein a side of the at least one stop, which faces an adjacent end surface of the second rail, is formed as a wedge-shaped bevel, and another side, which cooperates with a guide roller and serves as a stop surface, has a profile at least approximately corresponding to a circumferential profile of the guide roller, and wherein the at least one stop has a height corresponding approximately to a radius of the guide roller.

11. A lateral guide as set forth in claim 10, wherein the height of the at least one stop is greater than the radius of the guide roller.

12. A lateral guide as set forth in claim 1, wherein the at least one stop extends over a height of the one of the cheeks.

13. A lateral guide as set forth in claim 2, wherein the at least one stop is displaceable, in a direction opposite to the pull-out direction, into a locking position thereof.

14. A lateral guide as set forth in claim 1, wherein the first rail includes a first shaped rail securable to the one of an inner side of a top of the furniture member and an upper surface of the pull-out furniture section, and a second shaped rail carrying the guide rollers.

15. A lateral guide as set forth in claim 14, further comprising ball mean arranged between the first and second shaped rails to provide for displacement of the first and second shaped rails relative to each other.

* * * * *